US006111534A

United States Patent [19]

Escarmant

[11] Patent Number: 6,111,534

[45] Date of Patent: Aug. 29, 2000

[54] STRUCTURAL COMPOSITE MATERIAL ABSORBING RADAR WAVES AND USE OF SUCH A MATERIAL

[75] Inventor: Jean-François Escarmant, Bourges, France

[73] Assignee: Giat Industries, Versailles, France

[21] Appl. No.: 09/200,975

[22] Filed: Nov. 30, 1998

[30] Foreign Application Priority Data

Dec. 11, 1997 [FR] France ..... 97 15681

[51] Int. Cl.[7] ..... H01Q 17/00

[52] U.S. Cl. ..... 342/1; 342/3; 89/36.08

[58] Field of Search ..... 342/1, 2, 3, 4; 89/36.08, 1.11

[56] References Cited

U.S. PATENT DOCUMENTS

| | | | |
|---|---|---|---|
| 3,568,195 | 3/1971 | Wesch et al. . | |
| 3,631,492 | 12/1971 | Suetake et al. . | |
| 3,680,107 | 7/1972 | Meinke et al. | 342/1 |
| 3,737,903 | 6/1973 | Suetake et al. | 342/1 |
| 3,938,152 | 2/1976 | Grimes et al. | 342/1 |
| 5,323,160 | 6/1994 | Kim et al. | 342/1 |

FOREIGN PATENT DOCUMENTS

| | | |
|---|---|---|
| 0 121 655 A2 | 10/1984 | European Pat. Off. . |
| 0 370 421 A1 | 5/1990 | European Pat. Off. . |
| 0 420 137 A2 | 4/1991 | European Pat. Off. . |
| 1 441 626 | 3/1969 | Germany . |
| 2 257 302 | 1/1993 | United Kingdom . |

*Primary Examiner*—Bernarr E. Gregory
*Attorney, Agent, or Firm*—Oliff & Berridge, PLC

[57] ABSTRACT

The invention relates to structural composite material able to absorb radar waves at frequencies of 18 GHz, 35 GHz and 94 GHz. This material comprises at least three layers of non-magnetic, dielectric material obtained by stacks of impregnated plies, including an outer layer with a low reflection index and losses having an effective dielectric permittivity of around 3, to promote the penetration of the incident radar waves, an intermediate layer having an effective dielectric permittivity of around 5, and an inner layer loaded with electrically conductive particles and having a substantial effective dielectric permittivity of around 15 to 20. The material may have applications in the manufacture of chests for military vehicles, for example.

8 Claims, 2 Drawing Sheets

STRUCTURAL COMPOSITE MATERIAL ABSORBING RADAR WAVES AND USE OF SUCH A MATERIAL

FIELD OF THE INVENTION

The technical scope of the present invention is that of structural composite materials absorbing radar waves.

On the battle field many threats are currently used that implement detection and/or guidance by radar waves. These are field radars carried by a vehicle or by an infantryman, heliported radars, missile target-seekers notably having millimetric waves for so-called smart munitions. With respect to this type of detection, the signatures of modern battle tanks and all armoured reconnaissance vehicles must be reduced as much as possible.

DESCRIPTION OF THE RELATED ART

One of the solutions that can be envisaged to reduce the likelihood of a battle tank being detected consists in using covering or chest structure materials able to substantially attenuate the reflection of the incident radar wave.

One difficulty lies in the design of a composite material having radar absorption properties in the frequency bands currently used in the battle field and which are situated at 8–18 GHz, at 35 GHz and at 94 GHz.

Composite materials able to produce such a performance are not currently known.

BRIEF SUMMARY OF THE INVENTION

The aim of the present invention is to supply a structural composite material able to absorb the incident radar radiation.

The subject of the invention is thus a structural composite material able to absorb radar waves at frequencies of 18 GHz, 35 GHz and 94 GHz, wherein it comprises at least three layers of non-magnetic, dielectric material obtained by stacks of impregnated plies:

- an outer layer with a low reflection index and losses having an effective dielectric permittivity of around 3, to promote the penetration of the incident radar waves,
- an intermediate layer having an effective dielectric permittivity of around 5,
- and an inner layer loaded with electrically conductive particles and having a substantial effective dielectric permittivity of around 15 to 20.

According to one embodiment, the impregnated plies are glass fibre or Nylon® combined with epoxy resin.

Generally speaking, the composite material can have a thickness of around 4 to 10 mm.

By way of example, the external layer has a thickness of around 1.5 to 4 mm, the intermediate layer a thickness of around 0.5 to 2.5 mm and the inner layer a thickness of around 1.5 to 3.5 mm.

According to another embodiment, the composite material has a total thickness of around 6.75 mm, the external, intermediate and inner layers having respective thicknesses of 2.75 mm, 1.5 mm and 2.5 mm.

Generally speaking, the electrically conductive particles are carbon granules having a diameter of less than 0.1 mm with a proportion in mass of less than 10%.

The invention also relates to the use of this material in the manufacture of walls for armoured vehicles having mechanical strength able to withstand pressure of around 1 tonne per $cm^2$ and providing attenuation of the radar waves of more than 10 dB.

By way of a variant, such a composite material can also be used to manufacture utility or protection chests for armoured vehicles.

The composite material according to the invention has the advantage of replacing all the composites used on armoured vehicles in those places where there is a need to reduce radar reflectivity. In addition to its radar absorption performances, it possesses all the properties of mechanical strength of the usual composites implemented on armoured vehicles.

Thus, the material according to the invention can notably be used to manufacture the on-board chests, the double roof and all the composite double walls intended for heat insulation and the evacuation of the heat flow, for example to the rear near to the exhaust.

Lastly, the composite material according to the invention is obtained without modifying the current manufacturing process of existing structural composites.

BRIEF DESCRIPTION OF THE DRAWINGS

Other characteristics, particulars and advantages of the invention will become apparent after reading the following additional description of an embodiment of the invention given by way of example in relation to the drawings in which.

DETAILED DESCRIPTION OF THE INVENTION

The concept behind the invention is based on the adaptation of a multi-layer structure that, by acting on the internal resonance of the different layers, enables substantial absorption to be obtained in several frequency bands. We have found that a three-layer material offered a satisfactory trade-off to obtain radar absorption performances and mechanical performances. Thus, a utility chest made using this material according to the invention can be trampled over by a man wearing his full kit, of a mass of around 100 kg, without causing any fractures or permanent strain, which represents a pressure resistance of around 1 tonne per $cm^2$.

Figure 1:
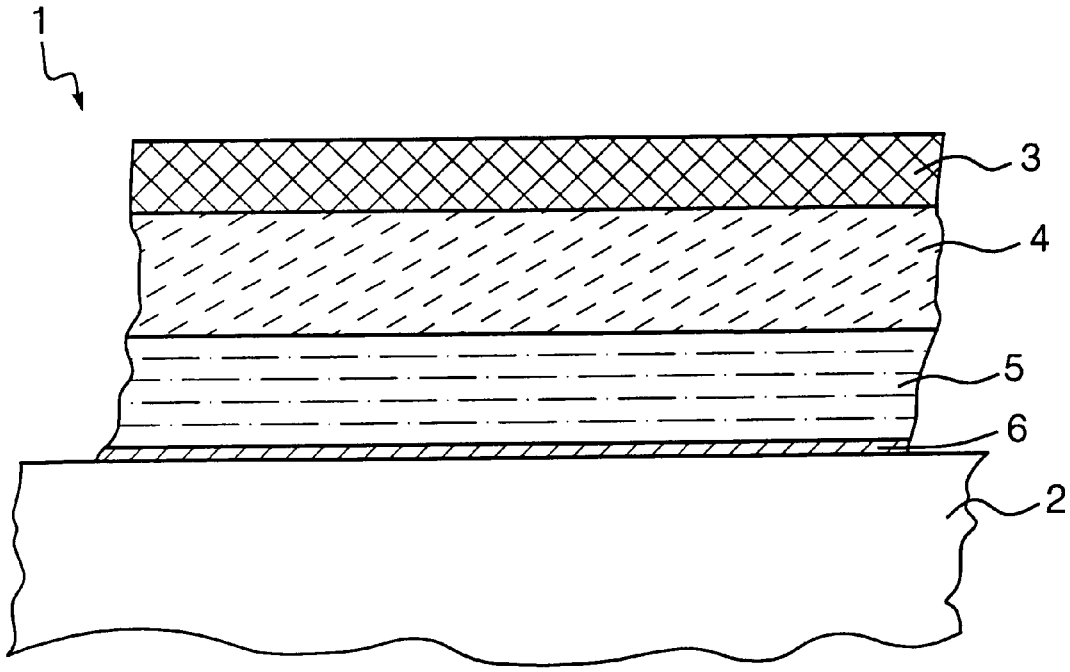
FIG. 1 is a section view showing the arrangement of the layers of composite material according to the invention.

In FIG. 1, structural composite material 1 is applied to a support 2 formed of the wall of an armoured vehicle (not shown).

Outer layer 3 is formed of a non-magnetic dielectric material having a low radar wave reflection index, low dielectric loss and with an effective dielectric permittivity of around 3. This layer must promote the penetration of the radar wave in the structure by impedance adaptation. Such a layer can be made of Nylon® (or its generic terminology being "any of a family of high-strength, resilient synthetic polymers containing recurring amide groups, or cloth or yarn made from one of these synthetic materials") fibres and an epoxy resin, for example.

Intermediate layer 4 is formed of a non-magnetic dielectric material whose dielectric losses are greater than for external layer 3, with an effective dielectric permittivity of around 5.

Inner layer 5 is made of a non-magnetic dielectric material loaded with carbon particles with a substantial electrical conductivity, and procuring this material more substantial electromagnetic wave absorption than that of the first two layers. The effective dielectric permittivity of this layer is more substantial, around 15 to 20.

It must be noted that none of these layers are absorbent enough in themselves to produce the desired radar absorption performances if used alone and whatever their thickness.

Material 1 is finished off in a known manner by a metallic layer 6 formed of an aluminium film of a thickness of around 0.1 mm, for example.

Layers 4 and 5 are composites made using epoxy resin and glass fibre material E.

It must be noted that the manufacturing process for these three layers is quite classical and does not require the classical manufacturing process of structural composite materials to be adapted in any way.

Material 1 according to the invention can have a thickness of around 4 to 10 mm, advantageously around 6.75 mm. External 3, intermediate 4 and inner 5 layers can respectively have a thickness of around 1.5 to 4 mm, 0.5 to 2.5 mm and 1.5 to 3.5 mm. Advantageously, these three layers have respective thicknesses of 2.75 mm, 1.5 mm and 2.5 mm.

Figure 2:
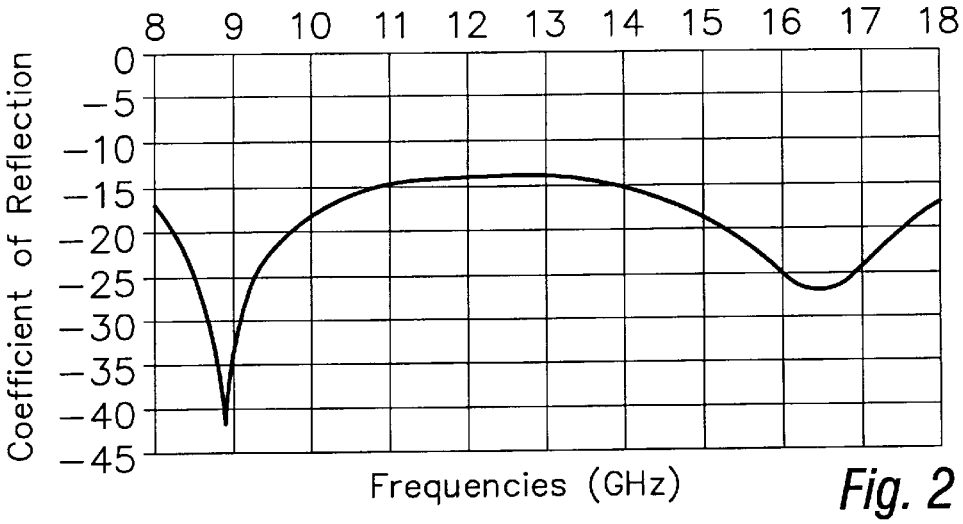
FIGS. 2 to 4 are curves illustrating the radar wave attenuation performances of this composite material in the three aforementioned frequency bands.
Figure 3:
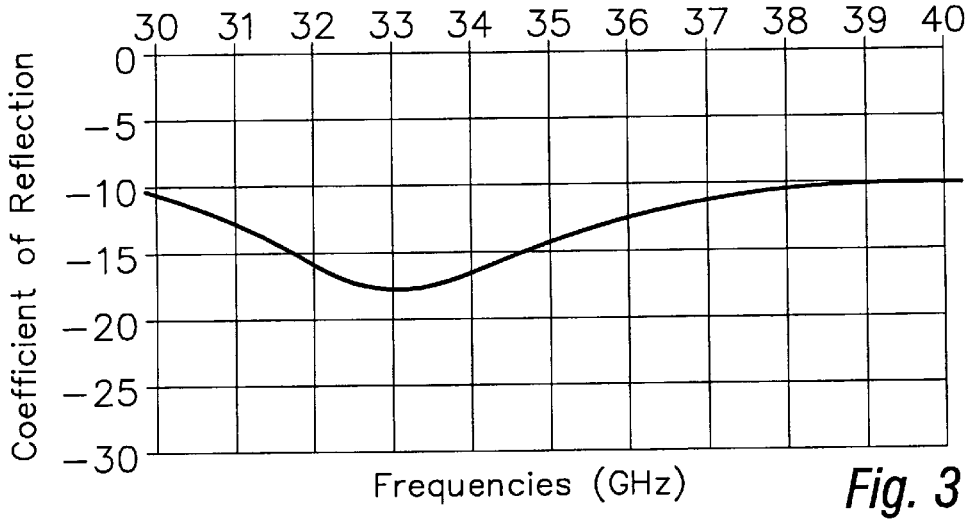
Figure 4:
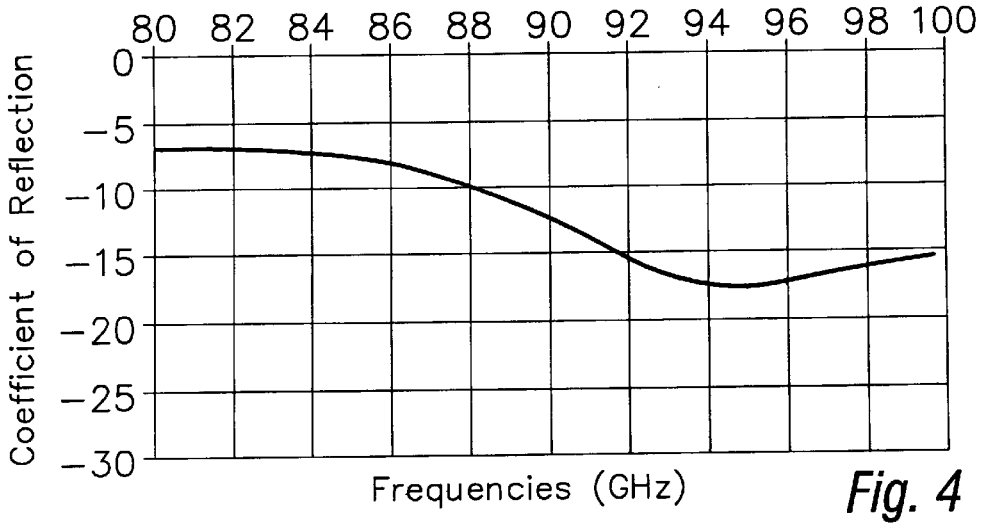

FIGS. 2 to 4 are graphic representations of the variation of the reflection coefficient as a function of the frequency. We note that for the three bands 8 to 18 GHz, 35 GHz and 94 GHz, we obtain a reflection attenuation of over 13 dB. This attenuation performance is quite satisfactory for the envisaged field of use.

What is claimed is:

1. A structural composite material able to absorb radar waves at frequencies of 18 GHz, 35 GHz and 94 GHz, wherein the structural composite material comprises at least three layers of non-magnetic, dielectric material obtained by stacks of impregnated plies, the layers comprising:

an external layer with a low reflection index and losses having an effective dielectric permittivity of approximately 3, to promote the penetration of the incident radar waves, an intermediate layer having an effective dielectric permittivity of approximately 5, and an inner layer loaded with electrically conductive particles and having a substantial effective dielectric permittivity of approximately 15 to 20.

2. A structural composite material according to claim 1, wherein said impregnated plies are at least one of glass fibre or nylon combined with epoxy resin.

3. A structural composite material according to claim 2, with a thickness of approximately 4 to 10 mm.

4. A structural composite material according to claim 3, wherein said external layer has a thickness of approximately 1.5 to 4 mm, the intermediate layer a thickness of approximately 0.5 to 2.5 mm and the inner layer a thickness of approximately 1.5 to 3.5 mm.

5. A structural composite material according to claim 4, wherein it has a total thickness of approximately 6.75 mm, said external, intermediate and inner layers having respective thicknesses of approximately 2.75 mm, 1.5 mm and 2.5 mm.

6. A structural composite material according to claim 1, wherein said electrically conductive particles are carbon granules having a diameter of less than 0.1 mm with a proportion in mass of less than 10%.

7. Walls for armored vehicles, comprising:

the structural composite material of claim 1, wherein the walls have mechanical strength able to withstand pressure of approximately 1 tonne per $cm^2$ and provide reflection attenuation of the radar waves of more than 10 dB.

8. The walls of claim 7, wherein the structural composite material is used for utility chests for the armored vehicles.

* * * * *